US012127627B2

(12) United States Patent
Bernhard et al.

(10) Patent No.: US 12,127,627 B2
(45) Date of Patent: Oct. 29, 2024

(54) MIDSOLE HAVING A CLEAR FREE SPACE

(71) Applicant: ON CLOUDS GMBH, Zürich (CH)

(72) Inventors: Olivier Bernhard, Heiden (CH); Ilmarin Heitz, Zürich (CH); Thilo Alex Brunner, Zürich (CH)

(73) Assignee: ON GLOUDS GMBH, Zürich (CH)

( * ) Notice: Subject to any disclaimer, the term of this patent is extended or adjusted under 35 U.S.C. 154(b) by 176 days.

(21) Appl. No.: 17/792,628

(22) PCT Filed: Jan. 21, 2021

(86) PCT No.: PCT/EP2021/051351
§ 371 (c)(1),
(2) Date: Jul. 13, 2022

(87) PCT Pub. No.: WO2021/148543
PCT Pub. Date: Jul. 29, 2021

(65) Prior Publication Data

US 2023/0041399 A1 Feb. 9, 2023

(30) Foreign Application Priority Data

Jan. 23, 2020 (CH) ..... 00078/20

(51) Int. Cl.
*A43B 13/18* (2006.01)
*A43B 13/12* (2006.01)
*A43B 13/37* (2006.01)

(52) U.S. Cl.
CPC ..... *A43B 13/185* (2013.01); *A43B 13/125* (2013.01); *A43B 13/37* (2013.01)

(58) Field of Classification Search
None
See application file for complete search history.

(56) References Cited

U.S. PATENT DOCUMENTS

| | | | | |
|---|---|---|---|---|
| 8,356,425 | B2 * | 1/2013 | Polegato Moretti | A43B 13/125 36/3 R |
| 8,510,970 | B2 * | 8/2013 | Baum | A43B 13/183 36/7.8 |
| 10,548,370 | B2 * | 2/2020 | Walsh | A43B 13/185 |
| 11,622,602 | B2 * | 4/2023 | Redon | A43B 13/141 36/28 |
| 2008/0005929 | A1 * | 1/2008 | Hardy | A43B 13/189 36/29 |

(Continued)

OTHER PUBLICATIONS

EPO (Riswijk, NL), English language version of the International Search Report, Form PCT/ISA/210, for International Application PCT/EP2021/051351, Mar. 31, 2021 (2 pages).

*Primary Examiner* — Jila M Mohandesi
(74) *Attorney, Agent, or Firm* — Pauley Erickson & Swanson

(57) ABSTRACT

A shoe sole (1) includes a stability support plate (3) and a soft elastic midsole (2) having a forefoot area (VFB), a midfoot area (MFB) and a heel area (FB). The stability support plate is peripherally surrounded by the midsole and the midsole (2) has a clear space (21) open to the bottom side (U) of the midsole (2), which is peripherally surrounded substantially completely by the midsole (2) and is delimited by the stability support plate (3). The clear space (21) extends from the heel area (FB) over the midfoot area (MFB) into the forefoot area (VFB) of the midsole (2).

21 Claims, 3 Drawing Sheets

(56) References Cited

U.S. PATENT DOCUMENTS

| | | | | |
|---|---|---|---|---|
| 2014/0305008 | A1* | 10/2014 | Wang | A43B 13/18<br>36/103 |
| 2019/0150563 | A1* | 5/2019 | Shorten | A43B 13/141 |

* cited by examiner

MIDSOLE HAVING A CLEAR FREE SPACE

CROSS REFERENCE TO RELATED APPLICATION

This application is a National Phase filing in the United States, under 35 USC §371, of PCT International Patent Application PCT/EP2021/051351, filed on 21 Jan. 2021 which claims the priority of Swiss Patent Application CH 00078/20, filed 21 Jan. 2020.

These applications are hereby incorporated by reference herein in their entirety and is made a part hereof, including but not limited to those portions which specifically appear hereinafter.

BACKGROUND OF THE INVENTION

Field of the Invention

The present invention relates to the field of footwear technology, in particular footwear for everyday use, such as sneakers, and relates to a sole for such a shoe.

Discussion of Related Art

A large number of everyday shoes with different cushioning systems are known in the prior art. Leisure shoes, such as sneakers, differ significantly in the requirements placed on the sole in terms of cushioning properties from sports shoes, especially running shoes. On the one hand, the stress on the foot in everyday life is typically much lower than in running. For another, the shoe remains on the ground longer than a typical running shoe for example when standing, which means that the stability requirements for the sole of such a shoe are different from those of a running shoe.

In the prior art soles with a gel core are for example known as a cushioning system. Leisure shoes with soles that have a gel core in the heel area to ensure vertical cushioning when stepping on are widely used. Furthermore, improvements in vertical cushioning properties have been achieved by placing individual spring elements in the heel area between the outsole and the insole. Other known solutions for cushioning include gases encapsulated in the sole and/or sealed air chambers.

SUMMARY OF THE INVENTION

The problem with known leisure shoes is their environmentally harmful production due to the relatively high proportion of polymer material from fossil sources that is required for the midsole. The normally relatively high proportion of polymer material in the shoe sole results in a high weight, which reduces wearing comfort and causes the wearer tire more quickly. In addition, an improvement in the cushioning effect is often achieved by additional polymer materials, which is problematic from an ecological point of view.

Known cushioning systems also have the disadvantage that energy is necessarily lost through the cushioning, which increases the force demanded from the wearer and thus causes quicker fatigue. Since cushioning systems typically increase the weight of the shoe, the fatigue that occurs is further amplified. Furthermore, while many known cushioning systems provide satisfactory cushioning of forces acting vertically during heel strike, these systems do however not provide adequate absorption of forces occurring horizontally, which is particularly problematic for people with knee and/or hip pain.

Another disadvantage of the cushioning systems known in the prior art is that they can result in instabilities which occur, among others, when standing. While this is due to the short contact with the ground of lesser importance in sports shoes, especially running shoes, this effect represents a significant loss of comfort in everyday and leisure shoes. A common problem in this regard is the floating effect triggered by the cushioning system or the sole design.

It is therefore the general object of the invention to advance the state of the art in the field of shoe soles and preferably to overcome the disadvantages of the prior art fully or partly.

In advantageous embodiments, a shoe sole is provided that has a satisfactory cushioning effect while reducing energy loss during push-off due to cushioning. In further advantageous embodiments, a sole is provided that has a low weight and can be manufactured in a more environmentally friendly and cost-effective manner. In further advantageous embodiments, a shoe sole is provided that can satisfactorily cushion both vertically and horizontally acting forces that occur during walking. In further advantageous embodiments, a shoe sole is provided that provides a stable stand and preferably prevents or reduces the floating effect.

In a first aspect of the invention, the general object is achieved by a shoe sole comprising a stability support plate and a midsole having a forefoot area, a midfoot area, and a heel area. The midsole has a clear space being open towards the bottom side of the midsole, which is peripherally substantially completely surrounded by the midsole, and which is delimited by the stability support plate. Thus, the midsole itself has a continuous central opening which is closed by the stability support plate. Open towards the bottom side means that the clear space is formed as a recess which is open when viewed from the ground in the worn state. The stability support plate typically delimits the clear space in the vertical direction. The clear space extends from the heel area through the midfoot area into the forefoot area of the midsole. In such a sole, the stability support plate is configured to support the weight force of the wearer and the peripherally surrounding midsole is configured to act as a support structure and cushioning system. In contrast to conventional soles, it is thus not the midsole but the stability support plate that acts as the main load-bearing element. The stability support plate thus allows the midsole to be reduced to the peripheral area of the shoe sole. Since the stability support plate has a much lower weight than midsoles made of common polymer materials, the weight of the shoe sole is significantly reduced. Typically, the stability support plate can be flexurally elastic and incompressible. Preferably, the stability support plate is at least partially exposed directly to the environment on the bottom side of the shoe sole and is therefore at least partially visible from the outside, respectively partially uncovered by the midsole, preferably in the area of the clear space.

Preferably, the midsole is configured such that the stability support plate does not come into contact with the ground during walking. For example, the midsole can form a web running peripherally, preferably completely, around the clear space. This web may have a width of 1 to 4 cm, preferably 2 to 4 cm. During walking, the web can come into contact with the ground either directly or via an outsole applied to the web.

The clear space is located in the center of the midsole. Since the clear space is completely surrounded by the midsole at the periphery, it does not extend to the outer side of the midsole. On the one hand, the clear space allows a significant weight saving and, on the other hand, the clear space facilitates bending of the stability support plate. This means that a more flexurally rigid plate can be used than with a sole without clear space, which can still be comfortably bent during walking and thus provides a high push-off energy. As a result, the wearer tires less quickly and has a more comfortable running sensation. In addition, the sole becomes more flexible, which also increases wearing comfort.

Directional indications as used in the present disclosure are to be understood as follows: The longitudinal direction L of the sole is described by an axis from the heel area to the forefoot area, and thus extends along the longitudinal axis of the sole. The transverse direction Q of the sole extends transversely to the longitudinal axis and substantially parallel to the bottom side of the sole, respectively substantially parallel to the ground. Thus, the transverse direction runs along a transverse axis of the sole. In the context of the present invention, the vertical direction V denotes a direction from the bottom side of the sole towards the insole, or in the operative state towards the foot of the wearer, and thus runs along a vertical axis of the sole. The outer side of the midsole refers to the peripherally circumferential outer region of the midsole. The medial area of the midsole is the region of a shoe of a pair of shoes which faces the second running shoe when worn. Accordingly, the lateral area of the midsole of a pair of running shoes designates the outer region of the midsole which, in the case of a pair of running shoes, faces away from the second running shoe in the worn state and is thus arranged opposite the medial area.

Soft-elastic materials for soles are well known to those skilled in the art. For example, materials with a Young's modulus of about 0.0001 to 0.2 GPa, especially 0.001 to 0.1 GPa, can be used. Typically, such materials may comprise polymer foams. Soft elastic materials may include rubber, ethylene-vinyl acetate copolymer (EVA), polyurethane, particularly thermoplastic polyurethane (TPU) or expanded thermoplastic polyurethane (eTPU), polyamides, e.g., PA-11, PA-12, nylon, polyethylene terephthalate (PET) or polybutylene terephthalate (TBT), or blends thereof.

The stability support plate may consist of a rigid polymer, e.g., LDPE, HDPE, polypropylene, etc., or carbon fibers or blends thereof. Further, the stability support plate may additionally or alternatively comprise or consist of a cured textile material. Preferably, the stability support plate is thus made of a different material than the midsole. The stability support plate is bent during the treading and rolling motion of the wearer. Due to the typically flexurally elastic property of the plate, the push-off process is assisted by the plate returning to its original, approximately flat shape. This effect is further enhanced by the clear space. The greater the clear space, or the greater the width in the transverse direction of the clear space, the more efficient the transfer of energy during the push-off. In addition, a significantly stiffer plate can be used since the clear space makes it easier to bend the stability support plate. Preferably, the stability support plate has a Shore Durometer of 60 to 70 Shore D, preferably 62 to 68 Shore D. The stability support plate can generally have a thickness, i.e., an extension in the vertical direction of up to 5 mm, in particular 1 to 5 mm, preferably 1.5 to 4 mm.

Typically, the stability support plate is configured such that the foot of the wearer is arranged substantially completely above the stability support plate in the operative state. Thus, the foot of the wearer is preferably not arranged directly above the midsole.

In some embodiments, the clear space in the transverse direction of the midsole has a width (clear width in the transverse direction) of at least 25% of the total width in the transverse direction of the midsole. For example, the width (clear width in transverse direction) may be at least 1 cm, preferably at least 1.5 cm, in particular between 1 cm and 5 cm, preferably between 1.5 cm and 5 cm. Due to the stability support plate, the clear space can be relatively wide without causing instability. The length (clear width in the longitudinal direction) of the clear space in the longitudinal direction can be at least 70%, in particular 70% to 95%, preferably 70% to 85% of the length of the midsole in the longitudinal direction. The length (clear width in the longitudinal direction) depends on the respective shoe size, but in some exemplary embodiments may be at least 20 cm, in particular between 20 and 30 cm.

In certain embodiments, the clear space in the transverse direction of the midsole has at least at one position a width (clear width in the transverse direction) of at least 1.5 cm, preferably at least 2 cm.

In some embodiments, the clear space may have a variable width (clear width in the transverse direction) in the transverse direction along its length in the longitudinal direction of the midsole. For example, the midsole surrounding the clear space may be curved, i.e., not straight, at the periphery of the clear space. Preferably, the clear space is completely peripherally surrounded by the midsole.

Preferably, the width (clear width in the transverse direction) of the clear space in the transverse direction is greater in the forefoot area than in the heel area and/or in the midfoot area, since in the forefoot area i.e., in the area of the wearer's metatarsophalangeal joints, the sole is bent during walking and therefore increased flexibility in this area is advantageous for wearing comfort and energy transfer during push-off.

In some embodiments, the midsole has a circumferential step for improved attachment of the stability support plate. In this case, the stability support plate is arranged at the step and/or fastened thereto. Preferably, the stability support plate is aligned with the midsole surrounding the stability support plate, so that the transition region between the stability support plate and the midsole is formed stepless in the vertical direction. Preferably, the step can be formed in the direction of the clear space or surround it substantially completely at the periphery.

In further embodiments, the top side of the stability support plate, i.e., the surface of the stability support plate facing the wearer's foot or facing the insole in the worn state, is uncovered by the midsole. The midsole thus only peripherally surrounds the stability support plate, thus saving material and environmentally harmful polymer material without reducing the wearing comfort and the cushioning effect.

In some embodiments, the length of the stability support plate in the longitudinal direction is at least 80%, preferably 80% to 95%, of the length of the midsole and/or the width of the stability support plate in the transverse direction (Q) is at least 50%, preferably 50 to 90%, of the width of the midsole in the transverse direction (Q). In such embodiments, it is ensured that the stability support plate holds the weight of the wearer and distributes it efficiently over the entire sole of the shoe, in particular over the peripherally circumferential midsole arranged below the stability support plate in the vertical direction.

In some embodiments, the midsole has a cavity in the heel area delimited by the midsole and the stability support plate. Such a cavity is provided in addition to the channels and is typically configured to provide an additional cushioning effect when the shoe first contacts the ground. The cavity can also be configured to compress elastically due to the forces that occur during walking. In general, the cavity can be completely or at least partially formed or delimited by the soft-elastic midsole.

Preferably, the cavity is completely enclosed. Thus, in such embodiments, the cavity is a fully enclosed cavity that is elastically compressible. For example, in such embodiments, the cavity may be completely delimited and closed by the soft elastic midsole, or completely delimited and closed by the soft elastic midsole and the stability support plate. Complete closure of the cavity can prevent stones or pieces of wood from becoming entrapped in the cavity.

In further embodiments, the cavity is arranged between the heel edge, i.e., the rearmost part of the midsole as seen in the longitudinal direction, and the clear space. In such embodiments, the cavity optimally complements the channels for cushioning, since the heel area, which first comes into contact with the ground, has a greatly improved cushioning effect.

In some embodiments, the midsole is at least partially provided with an outsole on the bottom side. Preferably, the lateral area of the midsole is fully provided with the outsole. The outsole may thereby have anti-slip properties. It has been shown that slipping can be efficiently prevented during treading and push-off if an anti-slip outsole is arranged only in the lateral area. At least in part of the medial area, such an outsole can be dispensed with due to the natural movement of the foot during walking, without the shoe slipping relative to the ground during walking. This can save both material and weight.

In particular, the outsole may not be an integral part of the midsole. For example, the outsole can be made of a different material than the midsole, which is e.g., more abrasion-resistant than the material of the soft elastic midsole.

The outsole can also be structured, which improves the anti-slip properties. The structuring can, for example, have regularly and irregularly arranged furrows or grooves.

In some embodiments, the midsole includes a plurality of channels configured as blind holes that open to the clear space and extend toward the outer side of the midsole.

However, the channels formed as blind holes are not through-going. Accordingly, the outer side of the midsole is preferably formed circumferentially and continuously from a single material and has no sidewise openings. Typically, the channels are configured and dimensioned to provide cushioning to the midsole so that the channels narrow, or at least partially close, during walking. Preferably, the channels are at least partially delimited by, or formed by, the soft elastic midsole. The stability support plate also prevents the deformation of the channels from being transmitted to the wearer's foot.

For the purposes of the present invention, a channel is to be understood as a recess which may typically be tubular in shape. Generally, a channel is wholly or partially delimited by channel walls. Typically, the channels are empty. The channels are at least partially collapsible. Since the channels are formed as blind holes, they are only open on one side. In preferred embodiments, the channels of the midsole may be substantially parallel to each other. In some embodiments, the height of the individual channels, i.e., the extension in the vertical direction may be between 1 mm and 1 cm, and/or the length of the channel, i.e., the extension of the individual channels in the longitudinal direction of the sole may be between 1 and 2.5 cm.

In some embodiments, the wall thickness between one end of the channel and the outer side of the midsole may be at least 3 mm, in particular 3 to 15 mm, preferably between 5 and 15 mm. Such a wall thickness efficiently prevents the occurrence of a floating effect and increases the stability of the sole.

In some embodiments, the channels are arranged in the heel area and in the midfoot area; in particular, the channels may be arranged only in the heel area and in the midfoot area, so that the forefoot area is free of channels. Since the initial contact of the foot normally takes place in the heel area, a good cushioning effect is particularly important in this area. The absence of channels in the forefoot area supports and improves the push-off, since cushioning channels in the forefoot area lead to a loss of energy during the push-off process.

In further embodiments, the channels are configured to be deformed by the forces occurring during running in the vertical and/or horizontal direction in such a way that the openings of the channels close at least ⅓, preferably at least ⅔. Preferably, the channels cannot be closed completely by the forces occurring during walking. It has been shown that in contrast to sports shoes, everyday and leisure shoes, require a lower cushioning effect. Since the channels preferably do not close completely, better stability is achieved, and the swimming effect is avoided or at least reduced.

The forces that occur during walking are typically due to the weight force exerted by the weight of the wearer, which can for example be between 40 and 120 kg, particularly between 50 and 100 kg.

In some embodiments, the channels, preferably all channels of the midsole, are delimited by the stability support plate and the soft elastic midsole. In some embodiments, the channels are completely delimited by the stability support plate and the soft elastic midsole. Typically, the stability support plate delimits the channels in the vertical direction.

Preferably, the channels, in particular all channels, may have a U-shaped cross-section in the longitudinal direction. In embodiments in which the channels are delimited by the soft-elastic midsole and the stability support plate, for example, the soft-elastic midsole forms the U-shape of the channels and the stability support plate delimits the U-shape in the vertical direction. A U-shaped cross-section is particularly advantageous because it can efficiently absorb not only vertically acting forces, but also optimally horizontally acting forces, such as those that occur when walking on uneven terrain.

In further embodiments, the midsole has one or more grooves extending in the transverse direction, which are arranged longitudinally in front of and/or behind a channel and open towards the bottom side of the midsole. Such grooves facilitate closure of the channel in the horizontal direction, i.e., in the longitudinal direction of the midsole. The channel can be sheared more easily due to this groove, which increases the cushioning effect for horizontally acting forces. In an everyday or leisure shoe, already one, two or three such grooves per side, i.e., on the lateral and the medial side, may be sufficient to achieve a sufficient cushioning effect. Moreover, a groove depth of 0.1 to 0.5 cm, preferably 0.1 to 0.3 cm, is already sufficient to achieve this effect.

Another aspect of the invention relates to a shoe comprising a shoe sole according to any of the embodiments as described herein.

In some embodiments, the shoe has an outer upper and an inner textile upper. These may be of non-integral design. In particular, the outer upper may be made of a different material, such as leather or synthetic leather, than the inner upper. The inner upper can typically be designed as a sock. In particular, the inner upper may be elastic. For example, an elastic inner upper may be designed to comprise a space with a smaller volume than the volume of the wearer's foot when unworn and stretched when worn. This achieves that the wearer's foot is tightly enclosed, which greatly increases the wearing comfort. For this purpose, the inner upper is designed to be at least partially freely movable relative to the outer upper. The skilled person understands that the inner upper may be connected to the outer upper at some positions. For example, the inner upper can be sewn or glued to the outer upper in the heel area. Preferably, however, the inner upper is configured to be movable relative to the outer upper at least in the midfoot area and/or in the forefoot area.

In some embodiments, the inner upper defines an interior space that is completely distinct from the outer upper and thus the wearer's foot does not come into contact with the outer upper.

Another aspect of the invention relates to the use of a shoe sole according to embodiments described herein in the manufacture of a shoe. In particular, the manufacture may thereby comprise attaching an upper to such a shoe sole.

BRIEF DESCRIPTION OF SEVERAL VIEWS OF THE DRAWINGS

Aspects of the invention are explained in more detail with reference to the embodiments shown in the following figures and the accompanying description.

DETAILED DESCRIPTION OF THE INVENTION

Figure 1:
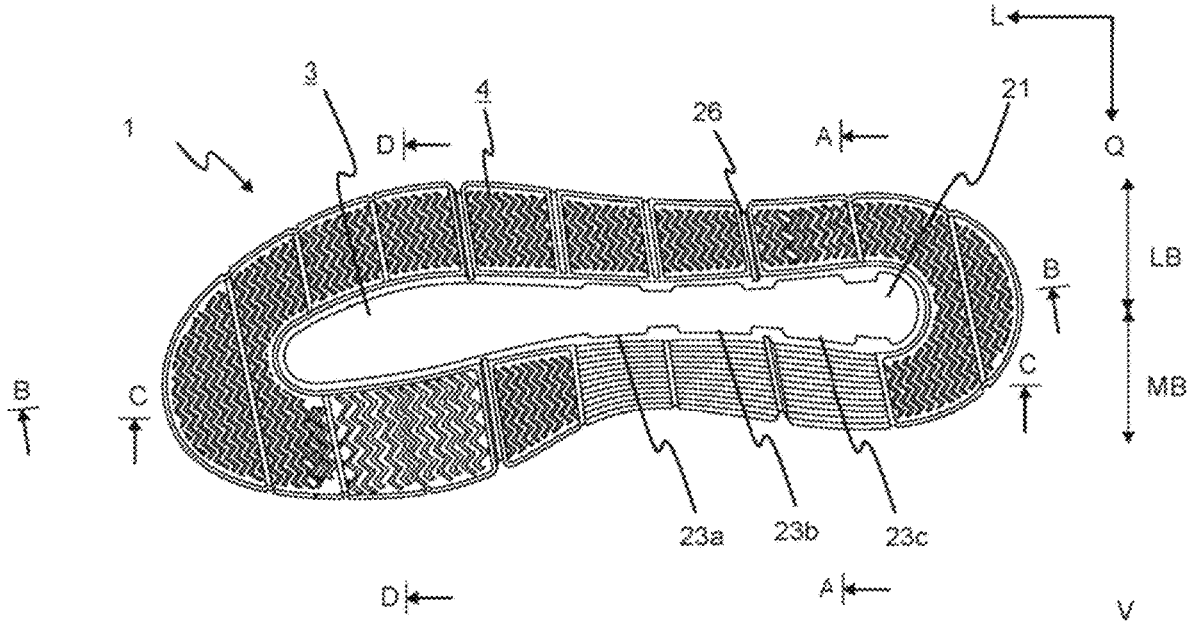
FIG. 1 shows a view from below on the bottom side of a sole according to the invention for a running shoe according to an embodiment of the invention.

FIG. 1 shows a view of the bottom side of a sole 1 according to an embodiment of the invention. The sole 1 comprises a midsole 2, which comprises a clear space 21. As can be seen in FIG. 1, the clear space 21 is peripherally completely surrounded by the midsole 2. In addition, the stability support plate 3 is shown, which delimits the clear space 21 in the vertical direction V, so that the stability support plate is exposed to the environment in the region of the clear space and is uncovered by the midsole in this area. The clear space 21 has a variable width along its length in longitudinal direction L. The width, i.e., the direct extension of the clear space 21 in the transverse direction Q, is greater in the forefoot area than in the midfoot area or in the heel area. This favors the energy transfer in the forefoot area during the push-off. In addition, the smaller width in the heel area and midfoot area leads to increased stability upon tread, as a floating effect is avoided. The reduced width effects that the medial (MB) and lateral (LB) areas are less able to move away from each other. The medial sole is formed such that the clear space 21 has a curved periphery. The channels 23*a*, 23*b* and 23*c* are open towards the clear space 21. The shown midsole 2 is provided with the structured outsole 4 in the complete lateral area LB and partially in the medial area MB. In the region of the channels 23*a*, 23*b* and 23*c*, the medial area is not provided with an outsole.

Figure 2:
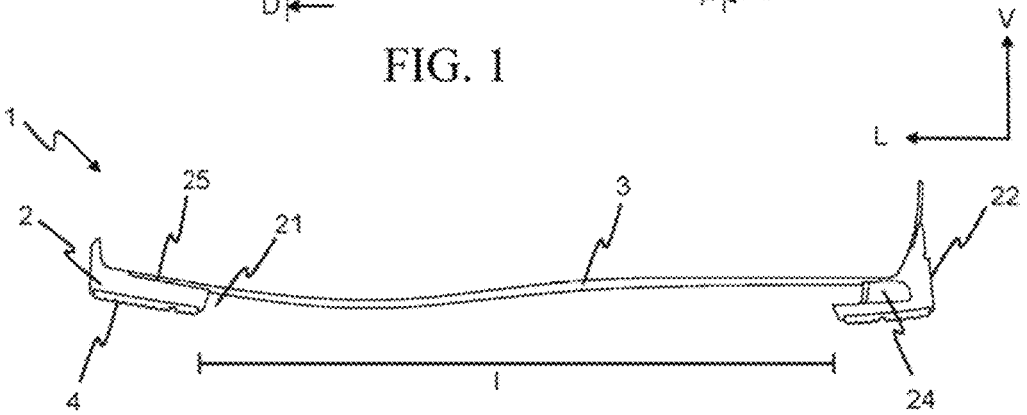
FIG. 2 shows a schematic longitudinal section along B-B according to FIG. 1 of the soleplate according to the embodiment shown in FIG. 1.

FIG. 2 shows a longitudinal section along B-B in the longitudinal direction L of the sole 1 shown in FIG. 1. The midsole 2 has the clear space 21 with clear width 1 in the longitudinal direction L, which is open towards the bottom side of the midsole 2 and thus towards the ground in the worn state and extends from the heel area FB via the midfoot area MFB into the forefoot area VFB. The clear space 21 is peripherally surrounded by the midsole 2 and delimited in the vertical direction V by the stability support plate 3. FIG. 2 clearly shows that the stability support plate 3 is peripherally surrounded by the midsole 2. As a result, a large part of the weight of the wearer first acts on the stability support plate and is distributed from there to the midsole peripherally surrounding it. Significant amounts of polymer material for the midsole can thus be saved, which reduces both manufacturing costs and environmental impact. The midsole 2 has a circumferential step 25 at which, respectively on which, the stability support plate 3 is arranged. In the longitudinal direction between the clear space 21 and the heel edge 22, the midsole 2 has a cavity 24 which is completely closed and is formed and delimited by the midsole 2 and the stability support plate 3.

Figure 3:
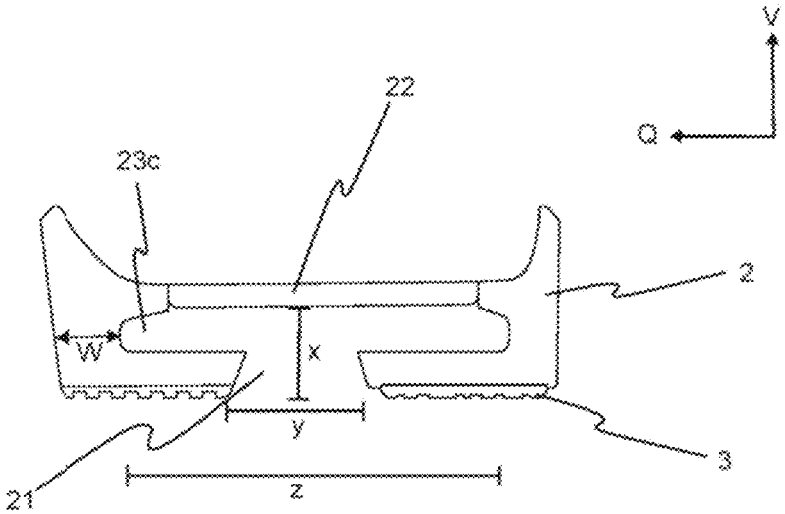
FIG. 3 shows a schematic section in the transverse direction along A-A according to FIG. 1 of a sole according to one embodiment of the invention.

FIG. 3 shows a cross-section of the embodiment shown in FIG. 1 along A-A (cf. FIG. 1). The cross-section runs through the channel 23*c*. It can be seen that the channel 23*c* is formed as a blind hole. The wall thickness W between the end of the channel and the outer side of the midsole can be at least 3 mm. The channel 23*c* is open towards the clear space 21 and is delimited in the vertical direction V by the stability support plate 3. The clear space 21 is also delimited in the vertical direction V by the stability support plate 3. The clear space 21 has the clear height x in the vertical direction V. In addition, the clear space generally has a maximum clear width z in the transverse direction Q in the region of the channel 23*c* and a smaller clear width y in the transverse direction Q on the bottom side of the sole.

Figure 4:
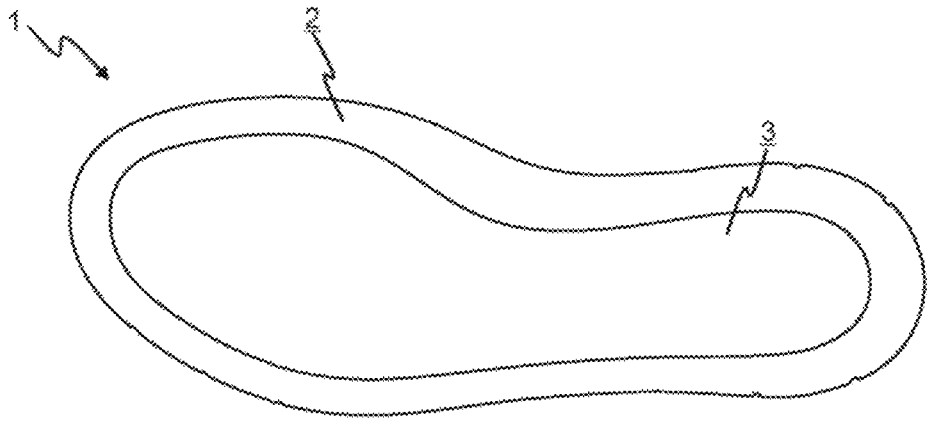
FIG. 4 shows a top view on the top side of a sole for a running shoe according to the invention.

FIG. 4 shows a view of the top side, i.e., that of the insole and the foot of the wearer of a shoe with sole 1 of a sole 1 according to the invention. It can be seen that the stability support plate 3 is completely surrounded peripherally by the midsole 2 and the top side of the stability support plate is uncovered by the midsole 2.

Figure 5:
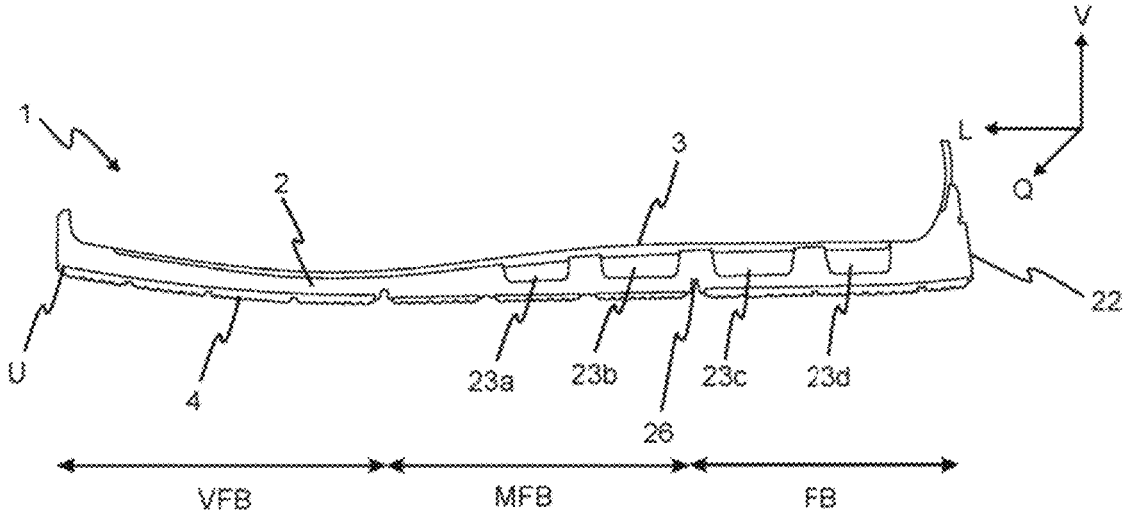
FIG. 5 shows a schematic longitudinal section in the lateral area in the longitudinal direction of a sole according to another embodiment of the invention.

FIG. 5 shows a sole 1 according to the invention in longitudinal section through the channels 23*a*, 23*b*, 23*c* and 23*d* along C-C according to FIG. 1. Sole 1 comprises a midsole 2, which comprises a heel area FB, a midfoot area MFB and a forefoot area VFB. In the heel area FB and in the midfoot area MFB, the midsole 2 comprises channels 23*a*, 23*b*, 23*c* and 23*d* extending in the transverse direction Q, which are each formed as blind holes and are arranged essentially parallel to one another. The forefoot region is free of channels. The channels 23*a*, 23*b*, 23*c* and 23*d* are U-shaped in cross-section in the longitudinal direction and are delimited in the vertical direction V by the stability support plate 3. Thus, the channels 23*a*, 23*b*, 23*c* and 23*d* are completely and exclusively delimited by the soft elastic midsole 2 and the stability support plate 3, regardless of the shape of the channels. The midsole 2 comprises in the longitudinal direction L in front of the channel 23*c* and behind the channel 23*b* a groove 26, which is arranged between the channels in the longitudinal direction and facilitates their horizontal shearing in the longitudinal direction L. The bottom side U of the midsole 2, i.e., the side facing the ground in the worn state, is provided with a structured outsole 4.

Figure 6:
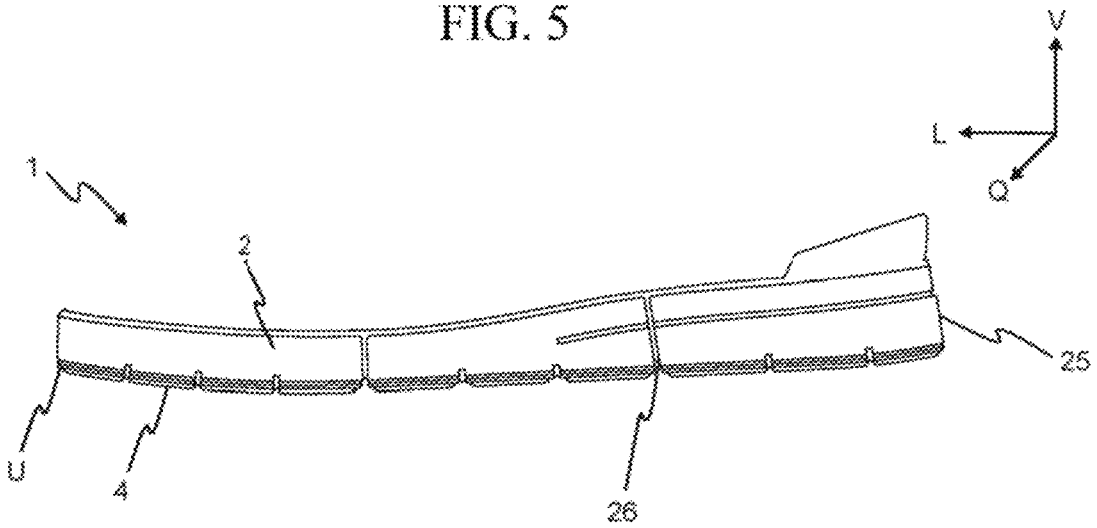
FIG. 6 shows a schematic side view of the sole according to the embodiment of the invention shown in FIG. 1.

FIG. 6 shows a schematic side view of the sole 1. It can be seen that the channels 23*a*, 23*b*, 23*c* and 23*d*, shown in FIG. 1, are blind holes, i.e., they extend towards the outer side of the midsole 2 but are not through-going, so that the outer side of the midsole 2, as shown in FIG. 5, generally has no channels or lateral openings.

Figure 7:
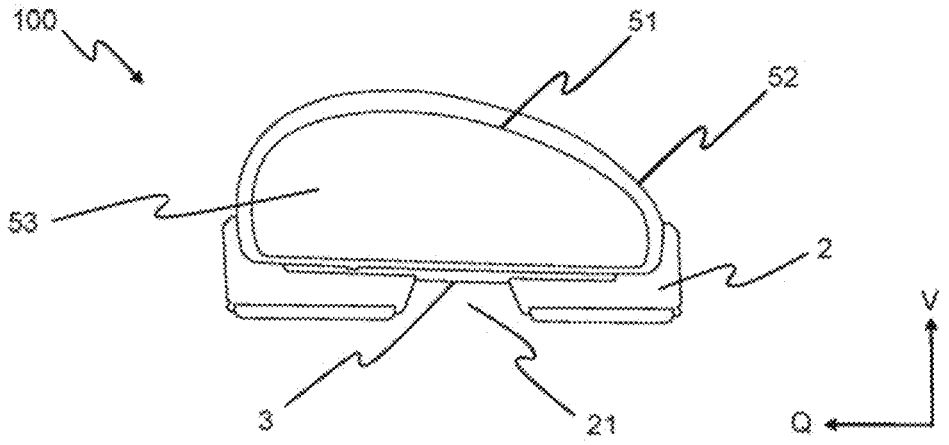
FIG. 7 shows a schematic cross-section in the forefoot area of a shoe according to the invention.

FIG. 7 shows a cross-section in the transverse direction Q along D-D according to FIG. 1 through the forefoot area of a shoe 100 according to the invention with a sole according to the invention. The sole comprises midsole 2 which comprises a clear space 21. The clear space 21 is peripherally completely surrounded by the midsole 2. In addition, the stability support plate 3 is shown, which delimits the clear space 21 in the vertical direction V. The shoe 100 also has an outer upper 52 and an inner upper 51. The inner upper 51 is formed such that an inner space 53 is defined, which is substantially completely segregated from the outer upper 52, so that the foot of the wearer, which is arranged in the inner space 53, does not come into contact with the outer upper. In the embodiment shown, the inner upper 51 in the forefoot area is substantially movable relative to the outer upper 52 and can be displaced against the latter to a certain extent.

The invention claimed is:

1. A shoe sole (1) comprising:

a stability support plate (3) and a soft-elastic midsole (2) having a forefoot area (VFB), a midfoot area (MFB) and a heel area (FB), wherein the stability support plate is peripherally surrounded by the midsole and wherein the midsole (2) comprises a clear space (21) being open towards a bottom side (U) of the midsole (2), which is peripherally surrounded substantially completely by the midsole (2) and which is delimited by the stability support plate (3), and wherein the clear space (21) extends from the heel area (FB) via the midfoot area (MFB) into the forefoot area (VFB) of the midsole (2), wherein the midsole (2) includes a plurality of channels (23*a*, 23*b*, 23*c*, 23*d*) configured as blind holes which are open towards the clear space (21) and extend towards an outer side of the midsole (2).

2. The shoe sole (1) according to claim 1, wherein the soft elastic midsole (2) comprises a circumferential step (25), wherein the stability support plate (3) is arranged on and/or attached to the step (25).

3. The shoe sole (1) according to claim 1, wherein the top side of the stability support plate (3) is uncovered by the midsole (2).

4. The shoe sole (1) according to claim 3, wherein the stability support plate (3) is aligned with the midsole (2) peripherally surrounding the stability support plate.

5. The shoe sole (1) according to claim 1, wherein a length of the stability support plate (3) in a longitudinal direction is at least 80% of a length of the midsole (2) and/or wherein a width of the stability support plate (3) in a transverse direction (Q) is at least 50% of a width of the midsole (2) in the transverse direction (Q).

6. The shoe sole (1) according to claim 1, wherein the midsole (2) comprises in the heel area (FB) a cavity (24) delimited by the midsole (2) and the stability support plate (3).

7. The shoe sole (1) according to claim 6, wherein the cavity (24) is completely closed by the stability support plate (3) and the soft elastic midsole (2).

8. The shoe sole (1) according to claim 6, wherein the cavity (24) is arranged between a heel edge (22) of the midsole (2) and the clear space (21).

9. The shoe sole (1) according to claim 1, wherein the midsole (2) is at least partially provided with an outsole (4) on the bottom side (U) and wherein a lateral area (LB) of the midsole (2) is completely provided with the outsole (4).

10. The shoe sole (1) according to claim 9, wherein the outsole (4) is structured.

11. The shoe sole (1) according to claim 1, wherein the channels (23*a*, 23*b*, 23*c*, 23*d*) are arranged in the heel area (FB) and in the midfoot area (MFB), and wherein preferably the forefoot area (VFB) is free of channels.

12. The shoe sole (1) according to claim 1, wherein the channels (23*a*, 23*b*, 23*c*, 23*d*) are configured to deform in vertical (V) and/or horizontal direction (L) by forces occurring during walking in such a way that the openings of the channels (23*a*, 23*b*, 23*c*, 23*d*) close at least up to ⅓, preferably at least up to ⅔.

13. The shoe sole (1) according to claim 1, wherein the channels (23*a*, 23*b*, 23*c*, 23*d*) are delimited by the stability support plate (3) and the soft elastic midsole (2).

14. The shoe sole (1) according to claim 1, wherein the midsole (2) comprises one or more grooves (26) extending in the transverse direction (Q), which are in the longitudinal direction (L) arranged in front of and/or behind a channel (23*b*, 23*c*) and are open towards the bottom side (U) of the midsole (2).

15. The shoe sole (1) according to claim 1, wherein a wall thickness (W) between an end of the channel (23*a*, 23*b*, 23*c*, 23*d*) and the outer side of the midsole (2) is at least 3 mm.

16. A shoe (100) comprising a shoe sole (1) according to claim 1.

17. The shoe (100) according to claim 16, wherein the shoe comprises an outer upper (52) and an inner textile upper (51).

18. The shoe according to claim 17 wherein the inner upper (52) defines an interior space (53) completely segregated from said outer upper by said inner upper (51).

19. A use of a shoe sole according to claim 1 in the manufacture of a shoe.

20. The shoe sole (1) according to claim 5, wherein a length of the stability support plate (3) in a longitudinal direction is 80% to 95% of a length of the midsole (2) and/or wherein a width of the stability support plate (3) in a transverse direction (Q) is 50 to 90% of a width of the midsole (2) in the transverse direction (Q).

21. The shoe sole (1) according to claim 9, wherein the midsole (2) is at least partially provided with an outsole (4) on the bottom side (U) and wherein a lateral area (LB) of the midsole (2) is completely provided with the outsole (4) and only a part of a medial area (MB) of the midsole (2) is provided with the outsole (4).

* * * * *